US011712601B2

(12) United States Patent
Mills et al.

(10) Patent No.: US 11,712,601 B2
(45) Date of Patent: Aug. 1, 2023

(54) EXERCISE DEVICE

(71) Applicant: MILLZ, Inc., San Francisco, CA (US)

(72) Inventors: Jessica Mills, San Francisco, CA (US); Soren Mills, San Francisco, CA (US); Stephen Bradford, Reno, NV (US); Tylor Garland, Los Angeles, CA (US); Jakub Waligorski, Los Angeles, CA (US); Pongnut Kranikachul, Bangkok (TH); Naia Simon, Los Angeles, CA (US); Samantha Halem, New York, NY (US); Jennifer O'Griffin, San Francisco, CA (US); Mose O'Griffin, San Francisco, CA (US); Andrew Sebastian, Petaluma, CA (US); Jonathan Thomas Johnson, Atlanta, GA (US)

( * ) Notice: Subject to any disclaimer, the term of this patent is extended or adjusted under 35 U.S.C. 154(b) by 132 days.

(21) Appl. No.: 17/335,668

(22) Filed: Jun. 1, 2021

(65) Prior Publication Data

US 2022/0008782 A1 Jan. 13, 2022

Related U.S. Application Data

(63) Continuation-in-part of application No. 17/066,467, filed on Oct. 8, 2020, which is a continuation-in-part
(Continued)

(51) Int. Cl.
*A63B 22/20* (2006.01)
*A63B 22/16* (2006.01)
(Continued)

(52) U.S. Cl.
CPC ..... *A63B 22/20* (2013.01); *A63B 21/023* (2013.01); *A63B 21/0435* (2013.01);
(Continued)

(58) Field of Classification Search
CPC ..... A63C 17/01; A63B 22/16; A63B 22/20
See application file for complete search history.

(56) References Cited

U.S. PATENT DOCUMENTS 1,824,920 A 9/1931 Novak
2,131,570 A 9/1938 Riley
(Continued)

FOREIGN PATENT DOCUMENTS

BR PI0520476 A2 6/2010
CN 1240452 C 2/2006
(Continued)

OTHER PUBLICATIONS

PCT International Search Report and Written Opinion from PCT/US2021/053843 dated Feb. 28, 2022,.
(Continued)

*Primary Examiner* — Erez Gurari
(74) *Attorney, Agent, or Firm* — Joseph M. Kobzeff

(57) ABSTRACT

An exercise device is described which includes a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; a first motor configured to apply a first torque to the first wheel where the magnitude of the first torque is related to the distance of the exercise device from a zero position and the direction of the first torque urges movement of the exercise device toward the zero position. Versions are also described with more wheels and more motors.

28 Claims, 4 Drawing Sheets

Related U.S. Application Data of application No. 16/436,907, filed on Jun. 10, 2019, now abandoned, which is a continuation of application No. PCT/US2017/031838, filed on May 9, 2017, which is a continuation of application No. 15/590,983, filed on May 9, 2017, now Pat. No. 9,993,686.

(60) Provisional application No. 62/432,255, filed on Dec. 9, 2016.

(51) Int. Cl.

| | |
|---|---|
| ***A63B 21/02*** | (2006.01) |
| ***A63B 21/04*** | (2006.01) |
| ***A63B 21/045*** | (2006.01) |
| ***A63B 23/02*** | (2006.01) |
| ***A63B 23/035*** | (2006.01) |
| *A63C 17/01* | (2006.01) |
| *A63B 21/00* | (2006.01) |

(52) U.S. Cl.

CPC ..... *A63B 21/0455* (2013.01); *A63B 22/16* (2013.01); *A63B 23/0216* (2013.01); *A63B 23/0355* (2013.01); *A63B 23/03525* (2013.01); *A63B 21/4034* (2015.10); *A63B 2208/0219* (2013.01); *A63B 2208/0228* (2013.01); *A63B 2208/0295* (2013.01); *A63C 17/01* (2013.01)

(56) References Cited

U.S. PATENT DOCUMENTS

| | | | | |
|---|---|---|---|---|
| 2,973,962 | A | 3/1961 | Griffin | |
| 3,403,906 | A | 10/1968 | Burzenski | |
| 3,752,475 | A | 8/1973 | Ott | |
| 4,073,356 | A * | 2/1978 | Schlicht | A63C 17/01 180/181 |
| 4,136,867 | A | 1/1979 | Wilken | |
| 4,177,803 | A | 12/1979 | Papistas-Scherer | |
| 4,911,440 | A | 3/1990 | Hyman | |
| 5,004,229 | A | 4/1991 | Lind | |
| 5,577,981 | A | 11/1996 | Jarvik | |
| 5,669,864 | A | 9/1997 | Blister | |
| 5,707,325 | A | 1/1998 | Chiou | |
| 6,017,296 | A | 1/2000 | Tang | |
| 6,050,357 | A | 4/2000 | Staelin | |
| 6,053,853 | A | 4/2000 | Hinds | |
| 6,328,680 | B1 | 12/2001 | Shifferaw | |
| 6,348,027 | B1 | 2/2002 | Lee | |
| D454,929 | S | 3/2002 | Huang | |
| 6,409,639 | B1 | 6/2002 | Kuo | |
| 6,500,105 | B1 | 12/2002 | Kuo | |
| 6,575,883 | B1 | 6/2003 | Hinds | |
| 6,585,627 | B2 | 7/2003 | Fernandez | |
| 6,761,611 | B2 | 7/2004 | Wood | |
| 7,175,573 | B1 | 2/2007 | Huang | |
| 7,837,603 | B1 | 11/2010 | Carnell | |
| 7,951,052 | B1 | 5/2011 | Tang | |
| D697,148 | S | 1/2014 | Lin | |
| 8,647,239 | B1 | 2/2014 | Sokolovas | |
| 8,814,767 | B2 | 8/2014 | Brodbeck | |
| 9,011,303 | B2 | 4/2015 | MacColl | |
| 9,144,709 | B2 | 9/2015 | Reich | |
| 9,440,134 | B2 | 9/2016 | Nicora | |
| 9,724,563 | B2 | 8/2017 | Schmidt | |
| 9,844,256 | B2 | 12/2017 | Kessling | |
| 9,993,686 | B1 * | 6/2018 | Mills | A63B 21/023 |
| 10,010,784 | B1 * | 7/2018 | Doerksen | A63C 17/0046 |
| 10,046,198 | B1 | 8/2018 | Huang | |
| 10,335,626 | B2 | 7/2019 | Orady | |
| 10,486,015 | B2 | 11/2019 | Valente | |
| 10,589,163 | B2 | 3/2020 | Orady | |
| 10,617,903 | B2 | 4/2020 | Orady | |
| 10,661,112 | B2 | 5/2020 | Orady | |
| 10,792,539 | B1 | 10/2020 | Gilstrom | |
| 10,874,897 | B1 * | 12/2020 | Eastham, Jr. | A63B 21/0051 |
| 2002/0025894 | A1 | 2/2002 | Fernandez | |
| 2002/0123416 | A1 | 9/2002 | Huang | |
| 2002/0128130 | A1 | 9/2002 | Miraflor | |
| 2003/0022770 | A1 * | 1/2003 | Lee | A63B 22/20 482/136 |
| 2003/0032536 | A1 | 2/2003 | Mabe et al. | |
| 2003/0134716 | A1 | 7/2003 | Yu | |
| 2003/0158023 | A1 | 8/2003 | Yu | |
| 2007/0254789 | A1 * | 11/2007 | Odien | A63B 26/003 482/92 |
| 2008/0242515 | A1 * | 10/2008 | Odien | A63B 26/003 482/146 |
| 2010/0222180 | A1 * | 9/2010 | Takizawa | A63B 21/00178 482/8 |
| 2010/0292060 | A1 | 11/2010 | Barufka | |
| 2010/0304941 | A1 | 12/2010 | Ota | |
| 2011/0275482 | A1 | 11/2011 | Brodess | |
| 2011/0295165 | A1 * | 12/2011 | Cavallaro | A63B 21/4017 601/33 |
| 2015/0182792 | A1 * | 7/2015 | MacColl | A63B 22/20 482/132 |
| 2016/0101314 | A1 | 4/2016 | Exley | |
| 2017/0216652 | A1 | 8/2017 | Scott | |
| 2018/0178111 | A1 * | 6/2018 | Ma | A63C 17/12 |
| 2019/0031254 | A1 * | 1/2019 | Pang | A63C 17/26 |
| 2019/0290957 | A1 | 9/2019 | Mills | |
| 2019/0366155 | A1 * | 12/2019 | Takizawa | G06Q 50/22 |
| 2020/0061446 | A1 * | 2/2020 | Chuang | A63B 21/00185 |
| 2020/0238158 | A1 * | 7/2020 | Han | A63C 17/14 |
| 2021/0128401 | A1 * | 5/2021 | Yao | A63C 17/12 |
| 2022/0008781 | A1 | 1/2022 | Mills | |
| 2022/0008782 | A1 * | 1/2022 | Mills | A63B 22/20 |
| 2022/0024536 | A1 * | 1/2022 | Chen | A63C 17/12 |

FOREIGN PATENT DOCUMENTS

| | | | |
|---|---|---|---|
| WO | 99/025430 | A1 | 5/1999 |
| WO | 2007/020663 | A1 | 2/2007 |
| WO | 2009/040808 | A1 | 4/2009 |
| WO | 2018/106282 | | 6/2018 |

OTHER PUBLICATIONS

Engine, (WIKIPEDIA) [online] retrieved from https://en.wikipedia.org/wiki/Engine; believed to have been retrieved in Feb. 2022, document is dated Feb. 16, 2022; entire document.

From U.S. Appl. No. 15/590,983 (now U.S. Pat. No. 9,993,686), Notice of Allowance dated Mar. 16, 2018.

From U.S. Appl. No. 15/590,983 (now U.S. Pat. No. 9,993,686), Office Action dated Oct. 27, 2017.

PCT International Preliminary Report on Patentability (Chapter II) from PCT/US2017/031838 dated Mar. 13, 2019.

From U.S. Appl. No. 16/436,907 (published as US 2019-0290957), Notice of Allowance dated Jul. 9, 2020.

PCT International Search Report and Written Opinion from PCT/US2017/031838 dated Jul. 28, 2017.

"Actuator", Merriam-Webster.com, 2017, available at https://www.merriam-webster.com/dictionary/actuator, accessed May 9, 2017.

"Clutch", Merriam-Webster.com, 2017, available at https://www.merriam-webster.com/dictionary/clutch, accessed May 9, 2017.

"Wheel", Merriam-Webster.com, 2017, available at https://www.merriam-webster.com/dictionary/wheel, accessed May 9, 2017.

U.S. Appl. No. 17/066,467, filed Oct. 8, 2020, Mills.

* cited by examiner

EXERCISE DEVICE

CROSS-REFERENCE TO RELATED APPLICATIONS

This is a continuation-in-part of U.S. patent application Ser. No. 17/066,467, filed on Oct. 8, 2020 which is a continuation-in-part of U.S. patent application Ser. No. 16/436,907 filed on Jun. 10, 2019, which is a continuation of International Patent Appl. No. PCT/US2017/031838 filed on May 9, 2017, which is a continuation of U.S. patent application Ser. No. 15/590,983 filed on May 9, 2017 (now U.S. Pat. No. 9,993,686 B1 issued on Jun. 12, 2018), which is a nonprovisional of and claims the benefit and priority of U.S. Provisional Patent Appl. No. 62/432,255 entitled "EXERCISE PLATFORM" and filed on Dec. 9, 2016, the disclosures of which are all incorporated herein by reference in their entireties.

TECHNICAL FIELD

This disclosure relates to exercise systems and devices including portable exercise devices that provide a resistance force or torque.

BACKGROUND

The present disclosure relates to exercise devices, such as can be used for various exercises to condition or strengthen various muscles, including the core, of a person. Exercise devices such as stationary machines, portable machines and small portable machines can be used for various exercise routines. Some exercise devices can provide a resistive force, such as through the use of springs, rubber bands, weights or gravity. Some exercise devices can be very sophisticated and provide a great deal of flexibility in performing a number of exercises, but be expensive to purchase and complicated to set-up and use.

One important group of muscles to exercise is frequently referred to as the "core." This group of muscles can include muscles of an individual's torso. In various definitions, the core can include one or more of the pelvic floor muscles, transversus abdominis, multifidus, internal and external obliques, rectus abdominis, erector spinae, longissimus thoracis, diaphragm, latissimus dorsi, gluteus maximum, trapezius, and other muscles as well. Having a strong core is believed to contribute to good posture and balance as well as decreasing back and joint pain, muscle fatigue, nerve pain and injury, improve blood circulation, blood pressure, personal energy and positive emotional outlook.

Exercises without exercise equipment can be used to provide general exercise, but exercise equipment can provide additional benefits to an exercise routine, such as to assist in improving form, improve targeting of individual muscles or muscle groups, facilitate a different/greater range of movement during the exercise and vary the resistance during the exercise as compared to exercise without equipment.

One option for individuals that would like to use exercise equipment during a workout would be to join a gym. However, gym memberships can be expensive and frequenting agent can be inconvenient. Purchasing exercise equipment can expensive and the equipment can be bulky. Accordingly, there is a need for compact and inexpensive exercise equipment which can assist in providing an improved exercise experience.

SUMMARY

In a first aspect, an exercise device is provided. The exercise device comprises: a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; a first motor configured to apply a first torque to the first wheel where the magnitude of the first torque is related to the distance of the exercise device from a zero position and the direction of the first torque urges movement of the exercise device toward the zero position.

In a first embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position.

In a second embodiment of the first aspect, the exercise device further comprises a stabilizing wheel system comprising one or more stabilizing wheels, wherein the one or more stabilizing wheels are positioned and configured to roll across the surface and to limit rotation of the platform in relation to the first and second wheel.

In a third embodiment of the first aspect, the surface comprises a continuous horizontal surface extending from the first wheel to the second wheel.

In a fourth embodiment of the first aspect, the surface comprises a first track and a second track where the first wheel rolls on the first track and the second track rolls on the second track.

In a fifth embodiment of the first aspect, the exercise device further comprises a stabilizing wheel system comprising one or more stabilizing wheels, wherein the one or more stabilizing wheels are positioned and configured to roll across the surface and to limit rotation of the platform in relation to the first and second wheel, and there are two stabilizing wheels.

In a sixth embodiment of the first aspect, the exercise device further comprises a stabilizing wheel system comprising one or more stabilizing wheels, wherein the one or more stabilizing wheels are positioned and configured to roll across the surface and to limit rotation of the platform in relation to the first and second wheel, and the first motor is configured to apply a second torque to the second wheel, where the magnitude of the second torque is related to the distance of the exercise device from the zero position and a direction of the second torque urges movement of the exercise device toward the zero position.

In a seventh embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof.

In an eighth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern is a linear curve with constant magnitude.

In an ninth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern has increasing magnitude with increasing distance from the zero position.

In a tenth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern has decreasing magnitude with increasing distance from the zero position.

In an eleventh embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern is a linear curve with increasing magnitude with increasing distance from the zero position.

In a twelfth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern has increasing then decreasing magnitude with increasing distance from zero.

In a thirteenth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern has decreasing then increasing magnitude with increasing distance from zero.

In a fourteenth embodiment of the first aspect, the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof, and the first pattern is different from the second pattern.

In a second aspect, a method of operating an exercise device is provided where the exercise device comprises: a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; a first motor configured to apply a first torque to the first wheel where the magnitude of the first torque is related to the distance of the exercise device from a zero position and the direction of the first torque urges movement of the exercise device toward the zero position, and the exercise device further comprises a second motor configured to apply a second torque to the second wheel where a magnitude of the second torque is related to the distance of the exercise device from the zero position and the direction of the second torque urges movement of the exercise device toward the zero position. The method comprises: the first or second motor applying a first or second torque to the first or second wheel, respectively as the exercise device is pushed across the surface away from the zero position, where the first or second torque opposes the motion of the exercise device; and the first or second motor applying a first or second torque to the first or second wheel, respectively as the exercise device is pushed across the surface toward the zero position, where the first or second anti-return force opposes the motion of the exercise device.

In a first embodiment of the second aspect, the first or second torque is changed to compensate for yaw of the exercise device.

In a second embodiment of the second aspect, the first or second torque is changed to compensate for tipping of the platform in relation to the first or second wheel.

In a third embodiment of the second aspect, the first or second torque is changed when the acceleration of the exercise device away from or toward the zero position exceeds a preset value.

In a third aspect, a method of operating an exercise device is provided where the exercise device comprises a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; a first motor configured to apply a first torque to the first wheel where the magnitude of the first torque is related to the distance of the exercise device from a zero position and the direction of the first torque urges movement of the exercise device toward the zero position, and the exercise device further comprises a second motor configured to apply a second torque to the second wheel where a magnitude of the second torque is related to the distance of the exercise device from the zero position and the direction of the second torque urges movement of the exercise device toward the zero position, and the magnitude of the first torque follows a first pattern as the distance from the zero position increases and the magnitude of the second torque follows a second pattern as the distance from the zero position decreases, where the first and the second pattern are independently selected from: a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof. The method comprises selecting the first or second pattern at the start of an exercise session.

In a fourth aspect, an exercise system is provided. The exercise system comprising:

an exercise device comprising: a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; a first motor configured to apply a first torque to the first wheel where the magnitude of the first torque is related to the distance of the exercise device from a zero position and the direction of the first torque urges movement of the exercise device toward the zero position; and a user interface configured to provide an indication of an exercise parameter achieved or an exercise deviation performed to a user of the exercise device.

In a first embodiment of the fourth aspect, the user interface provides a haptic indication to the user.

In a second embodiment of the fourth aspect, the user interface comprises a visual display in the exercise device.

In a third embodiment of the fourth aspect, the user interface comprises a visual display external to the exercise device.

In a fourth embodiment of the fourth aspect, the user interface comprises an audio signal.

In a fifth embodiment of the fourth aspect, the indication of an exercise parameter achieved comprises a display of a representation of the user's position operating the exercise device and a standard position of operation of the exercise device.

In a sixth embodiment of the fourth aspect, the indication of an exercise parameter achieved comprises an indication of a degree of success in achieving a standard movement form during operation of the exercise device.

In a fifth aspect, an exercise device is provided. The exercise device comprising: a platform having a first end and a second end opposite the first end; first and second wheels, wherein the first wheel is positioned proximate the first end and the second wheel is positioned proximate the second end and the first and second wheels are configured to roll across a surface as the exercise device is displaced along the surface; the first wheel applies a force that resists movement of the exercise device when the exercise device is moved from a zero position where a magnitude of the force is related to the distance of the exercise device from the zero position and a direction of the force urges the device toward the zero position.

DETAILED DESCRIPTION

Figure 1:
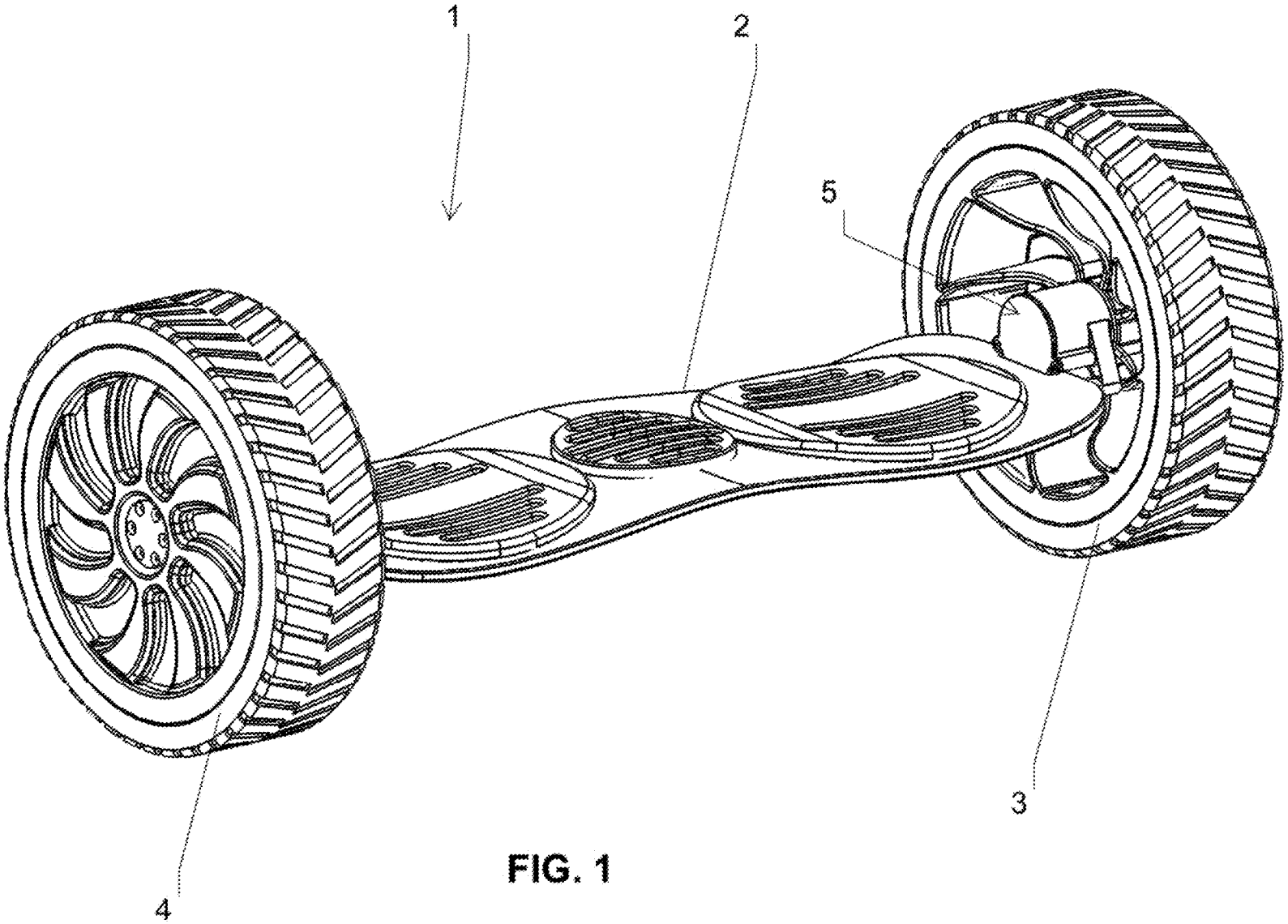
FIG. 1 shows an embodiment of an exercise device.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Embodiments of exercise devices described herein can be configured for and can be used for a range of exercises and styles of exercises. At least some such exercises and styles of exercise can include exercises that provide continuous resistance or where the whole body is engaged or where body weight is a part of the resistance that must be overcome as a part of the exercise. In some embodiments, the exercise can include supporting the torso through the exercise device. In some embodiments, the exercise device can be configured for and/or can be used to perform a range of yoga movements or Pilates movements. Examples of Pilates movements can include Pike to Plank, Knee Stretches, Long Stretches, Wheelbarrow, Off the Carriage Lunge, Reverse Plank and others. Examples of yoga movements can include Sun Salutation, Downward Facing Dog and others. Other exercise styles can also be performed, such as an Army Crawl routine and others. In some embodiments, the exercise device can be used in performing exercise routines that can also be performed on a tracked exercise device, such as a Pilates Reformer (for example, Studio Reformer® (Balanced Body Inc., Sacramento, Calif., USA), Allegro® 2 Reformer (Balanced Body Inc., Sacramento, Calif., USA), At Home SPX® Reformer (Merrithew Corp., Toronto, Ontario, Canada and the like), except that the present exercise device can utilize a virtual track rather than and actual track by way of control of left-right deviations as described herein. In some embodiments, the exercise device can be configured for and can be used for strength training or for stretching exercises. Embodiments of stretching exercises can include resistive stretching, assisted stretching, passive stretching and combinations thereof.

In resistive stretching, the exercise device can provide a force to the user that resists the stretching movement performed by the user that the user must overcome to move the exercise device. In some embodiments of resistive stretching, the exercise device can provide a stabilizing force that counters the weight of the user, while imparting an additional force that the user must overcome to move the exercise device. In some embodiments, the stabilizing force can hold the exercise device in a fixed position waiting for the user to initiate movement of the exercise device.

In forced stretching, the exercise device can provide movement that the user can follow or resist while performing a stretching movement. In one embodiment, the exercise device moves through the exercise motion while the user follows the motion while contacting the exercise device. The exercise device can overcome a degree of resistance to movement provided by the user. In some embodiments, the degree of resistance overcome by the exercise device can be set as a preset value or can be determined by the exercise device based upon one or more exercise performance parameters and/or exercise deviation parameter, or can be determined by external direction or combination thereof. Forced stretching can be used in such situations as where a user needs help to increase the extent of motion during a stretching exercise.

In passive stretching, the exercise device can follow the movements of the user performing a stretching movement without significantly forcing the movement (with the user resisting) or resisting the movement by the user. In some embodiments of passive stretching, the exercise device can provide a stabilizing force that counters the weight of the user, while allowing intentional movements of the user without significantly more force applied by the exercise device than that needed to counter the force applied by the user due to the weight of the user.

In each form of stretching, an exercise parameter or exercise device operational parameter (such as speed, torque, force, direction, exercise performance parameter, exercise deviation parameter, etc.) can be preset or determined based upon an action of the user or by external direction. In some embodiments, an exercise parameter or exercise operational parameter can be preset with modification based upon an action of the user, by external direction, or based upon exercise history, exercise performance parameter or exercise deviation parameter. Examples can include an audible command (e.g. start, stop, faster, slower, etc.), a sound or signal from a remote control, a movement of the exercise device (such as a tilt or other manipulation of the exercise device), a pause or halt in the operation of the exercise device, an exercise deviation or series of exercise deviations, environmental sound or signal (e.g. sound or signal due to a fall, broken equipment, timer, person entering the room, person calling or crying, animal sounds (vocal or otherwise), etc.) and exercise routine related (e.g. sound or signal from a recording or video of an exercise routine, interactive exercise routine such as a part of a local or remote exercise session conducted over television, the Internet, or other transmitted/received means, including all types of exercise class or session including in-person, pre-recorded, live, "virtual", "online", remote, computer generated, etc.)

In each form of stretching, an exercise movement can be initiated or stopped or restarted or continued or returned to a starting point or zero position by any suitable method such as the user initiating or stopping motion of the exercise device, Examples can include an audible command (e.g. start, stop, faster, slower, etc.), a sound or signal from a remote control, a movement of the exercise device (such as a tilt or other manipulation of the exercise device), an exercise deviation or series of exercise deviations, environmental sound or signal (e.g. sound or signal due to a fall, broken equipment, timer, person entering the room, person calling or crying, animal sounds (vocal or otherwise), etc.) and exercise routine related (e.g. sound or signal from a recording or video of an exercise routine, interactive exercise routine such as a part of a local or remote exercise session conducted over television, the Internet, or other transmitted/received means, including all types of exercise class or session including in-person, pre-recorded, live, "virtual", "online", remote, computer generated, etc.)

In each form of stretching, the extent of movement can be a constant from repetition to repetition, or can be varied from repetition to repetition. In some embodiments, the extent of movement can be increased with successive repetitions. In some embodiments, the extent of movement can be decreased with successive repetitions. In some embodiments, in a set of repetitions, successive repetitions can be a combination of two or more of constant, increasing and decreasing distances for successive repetitions.

In each form of stretching, the force provided by the exercise device in the respective form of stretching can be a constant from repetition to repetition, or can be varied from repetition to repetition. In some embodiments, the force can be increased with successive repetitions. In some embodiments, the force can be decreased with successive repetitions. In some embodiments, in a set of repetitions, successive repetitions can be a combination of two or more of constant, increasing and decreasing force for successive repetitions In some embodiments of each form of stretching, the exercise device can determine the extent of stretching movement the user can make or the extent of stretching movement can be controlled by the user in the user's operation of the exercise device.

In some embodiments, the exercise device can provide left-right direction stabilization to counter uneven force applied by the user to the exercise device. For example, if the user applies greater force to a first end (e.g. the left end) of the exercise device in comparison to second end (e.g. the right end), the exercise device can twist during operation resulting in yaw of the exercise device during operation. In one embodiment of the exercise device, the exercise device can adjust the force applied by the exercise device to counter the imbalanced left-right force applied by the user. One embodiment of countering uneven applied force can comprise applying different amounts of force on left and right wheels, such as by applying different torque at a left wheel as compared to a right wheel. In one such embodiment, a motor provides a different amount of torque to a left wheel as compared to a right wheel. Such differential torque can be applied from a common motor or by utilizing separate motors for the left wheel and the second wheel.

In various embodiments described herein, torque can be applied to one or more wheels. The torque can come from any number of devices, such as motor(s), spring(s), or other electrical or mechanical devices that can impart torque to the associated wheel(s). In the description provided herein, the word "motor" is used in multiple places as a shorthand way of referring to ways of applying torque to the wheel(s) and can also include other electrical torque sources and mechanical torque generating devices such as spring(s). Further, these different devices for applying torque to the wheel(s) can be used interchangeably or combined as desired.

Also as described herein, a battery is described and used to store energy to power a motor. However, other energy storage systems can be used, such as springs, capacitors and other electrical and mechanical energy storage devices. In the description provided herein, "battery" and "batteries" are also intended as a shorthand way of referring to these other energy storage systems and these energy storage systems can be used interchangeably or combined as desired.

As described herein, variation of torque applied to the wheel(s), variation of torque applied by the wheel(s), force applied by the exercise device, force applied by the wheel(s), stoppage of movement of the exercise device, variation of speed of the exercise device and variation of distance of the exercise device can be accomplished by varying the torque produced by motor(s) or by mechanical devices, such as with clutch(es), brake(s), cog(s), pawl(s), etc.

In the description provided herein, control of and variation of the torque applied to the wheel(s) and force produced by the exercise device are described in the context of motor(s) and varying the torque produced by the motor(s). In the description provided herein, this variation and control of torque and force, the discussion of a motor is also intended as a shorthand way of referring to control and variation of torque by way of other techniques, such as mechanical methods.

Further, the electrical control techniques described herein including those described as being used with motor(s) can also be integrated with and used with mechanical torque variation and with mechanical torque generation as a part of exercise devices.

The exercise device disclosed herein can be utilized by placing any appropriate portion of the user's body on the exercise device and following an exercise routine of moving the exercise device (or the exercise device moving the user, the user's body or portion of the user's body). Suitable portions of a user's body for placement on the exercise device can include, but is not limited to feet, hands, hips, back, butt, shoulders, arms legs, knees, elbows, chest, abdomen, and portions and combinations thereof. For convenience of description, the description herein has described the feet or hands as being used to contact the exercise device, but other portions of the user's body, such as these can be used.

The discussion below and in the Appendix primarily describe resistive stretching. However, forced stretching, passive stretching and strength exercises can also be performed by changing the direction and/or the magnitude of the force applied by the exercise device and are included in this disclosure.

FIG. 1 shows an embodiment of an exercise device 1 with two wheels 3, 4. In the embodiment shown in FIG. 1, a platform 2 has a first wheel 3 and a second wheel 4 located at opposite ends of the platform 2. A first motor 5 is located in functional communication with the first wheel 3 to apply torque to the first wheel 3. In some embodiments, a second motor 6 can be located in functional communication with the second wheel 4 to apply torque to the second wheel 4. In some embodiments, only one motor can be present to apply torque to both wheels, such as through a common shaft, a gearbox or a gearbox and clutch or a gearbox and differential arrangement. In some embodiments of a single motor configured to apply torque to the first 3 and second wheels 4, the same torque, an approximately same torque or a different torque can be applied to both the first and second wheels.

Exercise devices described herein can be operated, for example by a user pushing the exercise device 1 away from a zero position, which can be the starting position for an exercise with such movement opposed by the motor(s) of the exercise device 1, and allowing the motor(s) of the exercise device 1 to move the exercise device 1 back toward the zero position while being opposed by the user, the exercise device 1 can be operated by a user pulling the exercise device 1 away from the zero position with such movement opposed by the motor(s) of the exercise device 1, and allowing the motor(s) of the exercise device 1 to move the exercise device 1 back toward the zero position while being opposed by the user. The amount of effort required for the pushing, pulling and opposing can be varied by the user and by adjusting the torque applied by the motor(s).

In some embodiments of operating the exercise device 1, a user can place one or both hands on the platform 2, while the user's foot or feet are placed on a surface or on a platform. A surface can be a horizontal surface, such as the floor, table, platform, etc., or a vertical surface, such as a wall, barrier, etc., inclined, and can be flat or curved. The surface can also be a combination of these types of surfaces. The user can then push the exercise device 1 away from the zero position along the surface to an extended position. While the user pushes the exercise device 1 away from the zero position, the motor (or motors) can apply a torque to the wheel or wheels associated with the motor(s) that resists the pushing by the user. In some embodiments, the torque applied by the motor(s) can be a constant or a variable as the exercise device moves away from the zero position, such as by pushing by the user. In some embodiments of a variable torque, the torque can vary in relation to the distance between the exercise device and the zero position.

After the exercise device reaches the extended position, the exercise device can move along the surface toward the zero position with the motor(s) applying torque to the wheel(s) that urges the exercise device toward the zero position and the user can resist the movement caused by the torque of the motor(s). In some embodiments, the torque applied by the motor(s) can be a constant or a variable as the exercise device moves toward the zero point, such as while being opposed by the user. In some embodiments of a variable torque, the torque can vary in relation to the distance between the exercise device and the zero position.

In some embodiments, the user can pull the exercise device 1 away from the zero position along the surface to a compressed position. While the user pulls the exercise device 1 away from the zero position, the motor (or motors) can apply a torque to the wheel or wheels associated with the motor(s) that resists the pulling by the user. In some embodiments, the torque applied by the motor(s) can be a constant or a variable as the exercise device moves away from the zero position, such as by pulling by the user. In some embodiments of a variable torque, the torque can vary in relation to the distance between the exercise device and the zero position.

After the exercise device reaches the compressed position, the exercise device can move toward the zero position along the surface with the motor(s) applying torque to the wheel(s) that urges the exercise device toward the zero position and the user can resist the movement caused by the torque of the motor(s). If In some embodiments, the torque applied by the motor(s) can be a constant or a variable as the exercise device moves toward the zero point, such as while being opposed by the user. In some embodiments of a variable torque, the torque can vary in relation to the distance between the exercise device and the zero position.

In some embodiments of an exercise routine, various combinations of the above operations can be performed. For example, the exercise device can be pushed away from the zero position, followed by a return to the zero position, which is then followed by the exercise device being pushed away from the zero position. Another example of an exercise routine can include the exercise device being pushed away from the zero position, followed by a return to the zero position, which is then followed by the exercise device being pulled away from the zero position. In additional, shortened motions of the exercise device can be utilized during a routine, such as where the exercise device returns only partway to the zero position before changing direction to move away from the zero position, or where the exercise device is moved to a different distance from the zero position with a successive repetition before moving again toward the zero position.

Figure 2:
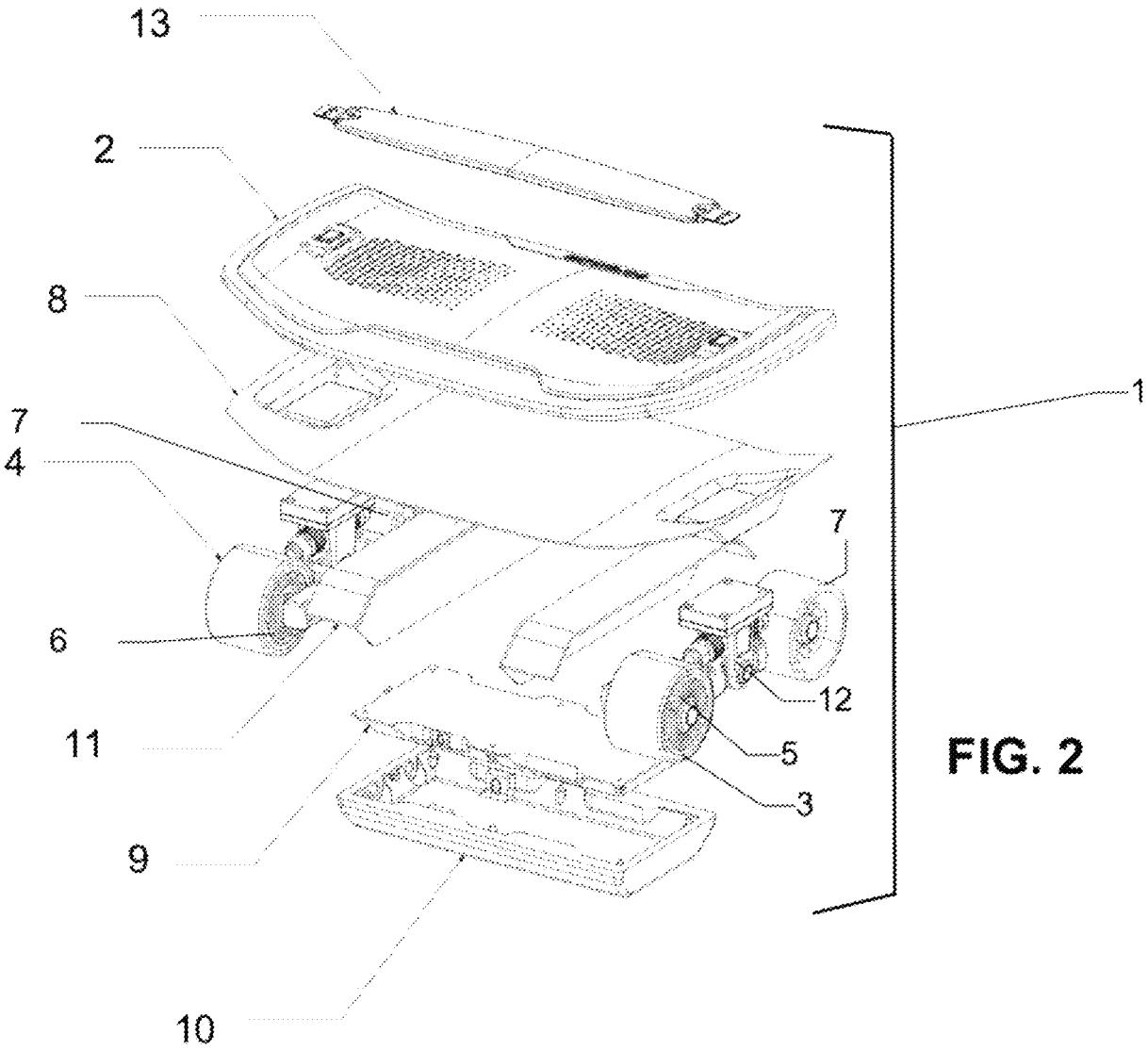
FIG. 2 shows an exploded diagram of an embodiment of an exercise device.

FIG. 2 shows an embodiment of an exercise device with a first wheel 3, a second wheel 4 and two stabilizing wheels 7. In some embodiments, only one stabilizing wheel 7 can be present. In some embodiments, more than two stabilizing wheels, such as three, four, five, six or more stabilizing wheels can be present. The stabilizing wheel(s) 7 are sized, configured and positioned to in combination with the first wheel 3 and second wheel 4 provide platform stability of the exercise device 1 by limiting or preventing rotation of the platform 2 around the first and/or second wheel 3, 4 of the exercise device.

FIG. 2 also shows a chassis 8 that can serve as a frame for attachment directly or indirectly, other parts, such as the platform 2, first wheel 3, second wheel 4, first motor 5, second motor 6, stabilizing wheel(s) 7, battery 9, battery cover 10, suspension assembly(ies) 12 and strap 13. In some embodiments, not all of the listed parts might be present, with one or more of these parts being absent or integrated into another part. For example, one or more of the second motor, one or both stabilizing wheels, battery cover, wheel guards, strap might be absent. Further, the chassis and platform might be present as an integrated single unit, the first and or second motor can be located within respective first and second wheels or be mounted separate from the wheel and in operational communication with the respective wheel.

Figure 3:
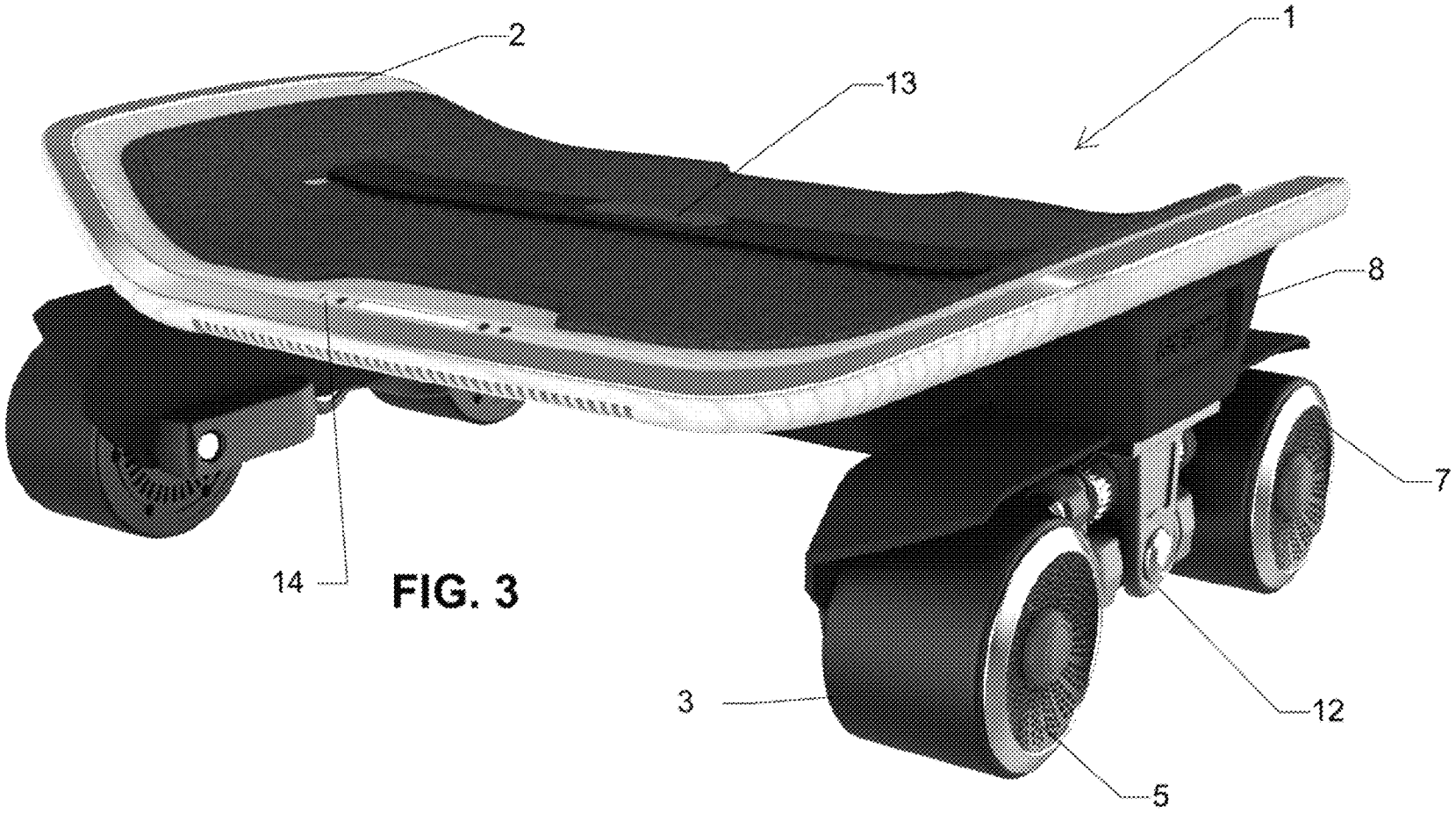
FIG. 3 shows an embodiment of an exercise device.
Figure 4:
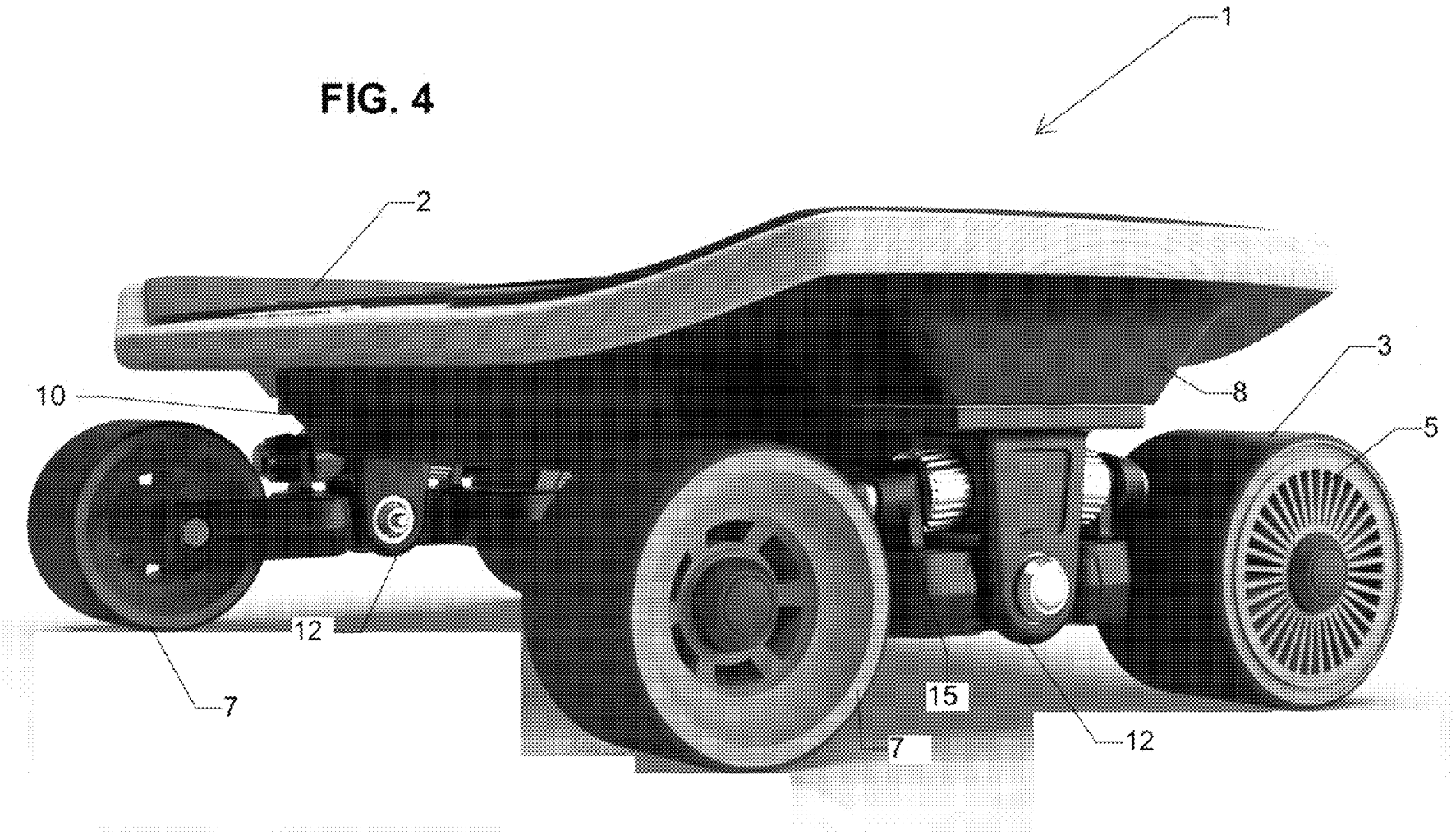
FIG. 4 shows an embodiment of an exercise device.

FIGS. 3 and 4 show embodiments of an exercise device 1 with a platform 2 and a strap 13. Also shown are first wheel 3, first motor 5, chassis 8, stabilizing wheel 7 and suspension assembly 12. FIG. 3 also shows user interface 14 with an indicator light. FIG. 4 also shows resilient bushing 15 in the suspension assembly.

The suspension assembly 12 can provide resistance to tilting of the platform in relation to the surface the exercise device travels. For example, resilient elements can provide resisted flexibility over a desired range of movement for the platform. In some embodiments the resilient element can be or comprise a bushing or a spring. In some embodiments, the bushing can comprise an elastomeric or plastic material that compresses or stretches or flexes with movement of the suspension assembly. In some embodiments, the spring can be any suitable type of spring, such as one that compresses, extends or flexes, such as coil, compression, extension, torsion, constant force belleville, drawbar, volute, garter, flat, or helical springs.

In various embodiments of an exercise device, the torque applied to the wheels can have a pattern when viewed from the perspective of the distance from the zero point where the pattern is a constant torque or a pattern that is a variable torque over the distance of the exercise device from a zero position or over a portion of the distance of the exercise device from a zero position. In some embodiments, the torque pattern can have a portion that is constant and a portion that is variable over the distance of the exercise device from the zero point. In some embodiments of a variable torque, the torque of the pattern can be related to the distance the exercise device has been moved from the zero position. For example, in one embodiment, the torque can have a pattern where the torque increases as the distance from the zero position increases. In other embodiments, the torque can have a pattern that increases then decreases. In additional embodiments, patterns that can be used can include a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero. In some embodiments, the torque profile over the entire movement of the exercise device away from or toward the zero position can follow a single pattern or a combination of patterns described herein and can optionally include repeated patterns.

In some embodiments of using the exercise device, the exercise device can operated by the exercise device moving away from the zero position followed by the exercise device moving toward the zero position. In some embodiments, the moving away from the zero position can be accomplished by a user pushing the exercise device. In some embodiments, the moving away from the zero position can be accomplished by a user by a user pulling the exercise device. In various embodiments, the torque profile of the exercise device moving away from the zero position can be the same or different from the torque profile of the exercise device moving toward the zero position.

Resistance and Stability Corrections

In some embodiments, the torque profile of the exercise device can be changed in response to how the user operates the user device. In one embodiment, the torque profile can be changed based upon a characteristic of the user's operation of the exercise device. In some embodiments, the characteristic can be a speed that the user moves the exercise device at, a steadiness of speed that the user operates the exercise device, the tilt or variability of the tilt of the platform of the exercise device, the linearity of the travel of the exercise device (i.e. how well the exercise device moves in a straight line), the twisting of the exercise device during operation ("yaw") or a combination thereof. In response to the characteristic being outside of a desired range or being higher or lower than a desired value, the torque can be increased or decreased from the profile value.

In one embodiment, when the speed of movement of the exercise device is higher than a preset value, the torque value can be increased or decreased to make the exercise device easier or harder to move.

In one embodiment, when the speed of movement of the exercise device has undesirable variations, such as when the movement includes accelerations or decelerations outside of a preset value, the torque value can be increased or decreased to make the exercise device easier or harder to move. In some embodiments, the accelerations and decelerations can be evaluated based upon the rate of acceleration (or deceleration), the duration of the acceleration (or deceleration), the frequency at which accelerations (or decelerations) occur or a combination of thereof.

In one embodiment, when the tilt of the platform is outside or a preset range or is greater or less than a preset value, the torque value can be increased or decreased to make the exercise device easier or harder to move.

In one embodiment, when the movement of the exercise device is insufficiently linear, such as when the exercise device moves to the left or the right or moves to one side and then the other in a way that exceeds a preset range or value, torque value can be increased or decreased to make the exercise device easier or harder to move. In some embodiments, the movements to the left or right or to one side and then the other can be evaluated based upon such parameters as the speed of movement to the side, the distance moved to the side, the frequency of changes of direction to the side, back to center (the desired direction of travel) or to the other side, or combinations thereof. In some embodiments, one or more of the torque value of the first and second motors can be varied in relation to one another to compensate for the movement to the side by the exercise device, such as by creating a countering torque that can steer the exercise device back to center.

In one embodiment, when the twisting movement or the twisting force (yaw movement or yaw force, both of which can be referred to as "yaw") on the exercise device is outside of a preset range or greater or smaller than a preset value, the torque value can be increased or decreased to make the exercise device easier or harder to move. In some embodiments, one or more of the torque value of the first and second motors can be varied in relation to one another to compensate for the twisting force or twisting movement applied to the exercise device, such as by creating a countering torque.

In various embodiments, the preset values and ranges described above can be a value entered by the user for an exercise session or a stored value or range, such as a value or range that was previously stored by the user or that is downloaded or that is entered by another or provided with the exercise device.

Interface

In some embodiments of an exercise device, a user interface can be provided. In some embodiments of a user interface, the user interface can provide the user with an indication of an exercise parameter achieved or an exercise deviation performed. In some embodiments, the indication provided can include a visual display, an audio display, a haptic indication or a combination thereof. In some embodiments, data from operation of the exercise device can be collected and stored in a memory or transferred to another device, such as an internal or external interface, and the data from operation can be analyzed for performance parameters or deviations and for logging of activity using the exercise device. User interfaces can also include one or more input interfaces or input interface component, such as an input interface or input interface component which can be used with equipment, computers, phones, etc. Suitable user interface and user interface components can include switches, buttons, dials, keypads, keyboards, mice, joystick, light pen, trackball, scanner, graphic tablet, microphone, magnetic ink reader, optical character reader, barcode reader, camera, touchpad, pointing stick, etc. Interfaces can also be provided for connection to connect to a phone, computer or data store (e.g. CD, DVD, flash drive, memory usable with a computer, etc.) Connections can be accomplished via wired or wireless techniques.

Suitable audio displays can include tones, buzzers, clicks, music, voice or other types of sounds. In some embodiments, the audio display can provide an alert, such as for accomplishment of a task or a deviation from a task. In some embodiments, the audio display can utilize varying pitch, varying volume, a vocabulary, etc.

Suitable haptic indication can include indications that are felt, and can be provided as haptic feedback through the platform or another part of the exercise device that contacts the user, including but not limited to vibration, tapping, shock, thermal, etc. Haptic feedback can also be provided through external devices, such as a remote, a worn device, such as a wristband, watch, finger clip, collar, chest strap, ankle strap, phone, etc. and can include types of haptic feedback as described for feedback through the platform.

Suitable visual displays can include one or more lights, a screen display, a video display or other display that can display information such as numbers, words, pictures or indicators of a condition. In some embodiments, a visual display can turn on a light or change a color, or display a representation of a person performing an exercise (for example a stick representation or a camera representation showing posture or form during performance of the exercise), a meter, etc. as well as combinations thereof. In some of these embodiments, the visual display can indicate an exercise task complete, incomplete, completed correctly, completed incorrectly, a score for an accomplishment, logged activity such as a cumulated set of accomplishments (including but not limited to time exercise, number of repetitions, distance moved, and in some embodiments the cumulated set of accomplishments can be displayed per session or per a period of time.)

In some embodiments, the display can be located on the exercise device, such as on the platform, or the display can be located on an external device, such as a wall, a screen, a computer display, a television, a phone, a remote or other device capable of displaying parameters, indicators of condition, pictures, etc. In some embodiments, the exercise device can interface with an external device, such as a computer, phone, television, remote, etc. and the external device can collect operating data from the exercise device.

In some embodiments, the interface can be used as a training aid to provide feedback on the quality of the exercise performed. In some embodiments, quality of exercise parameters can include parameters such as those related to the distance the exercise device is moved in a repetition, the steadiness of the movement (such as variation in speed), straightness of movement, twisting torque applied to the exercise device, tilt of the platform, speed of the exercise device, motor torque value, etc. In some embodiments, quality of exercise parameters can include parameters related to user form, such as the position that the user assumes during the use of the exercise device (such as head position, hip position, arm position, or position of other body parts during a repetition or part of a repetition.) In some embodiments, historical results of exercise results, such as quality of exercise parameters or exercise deviations (discussed below) can be displayed during or after an exercise session.

In various embodiments, the exercise quality parameter can be compared to a preset value or can be compared to parameter values from other repetitions (of the user or a different user), such as successive repetitions or an averaged set of repetitions or a standard deviation of repetitions.

In some embodiments, an exercise deviation parameter can be displayed, logged or alerted. Exercise deviations can include parameters that indicate a deviation from a preferred or an idealized exercise repetition. In some embodiments, exercise deviations can include changes in speed, changes in linearity of movement, unbalanced forces on the left side and right side of the exercise device (e.g. torque applied to the exercise platform), tilting of the platform, user posture, user position, etc.

In some embodiments, the user interface can provide an indication of an exercise deviation when it occurs, such as by turning on a light, changing the color of a light, displaying a picture that shows a representation of a deviation (for example, a display of a non-linear track with or without showing a linear track), or a representation of a user (stick figure, simplified person or picture or video of a person) with an area of the user's body that is exhibiting a position or posture deviation marked.

Sensors

Various sensors can be used in conjunction with embodiments of the exercise device. Examples of sensors that can be used with an embodiment of an exercise device include sensors that can be used to determine the amount of travel of the exercise device, a direction of travel of the exercise device, a tilt of the exercise device or a part of the exercise device (such as where one portion of the exercise device or part of the exercise device moves closer to the surface across which the exercise device travels as compared to another part of the exercise device or part of the exercise device), twisting of the exercise device or part of the exercise device (such as rotation around an axis normal to the surface the exercise device travels across), contact by a user, location of contact by a user, geographic location of the exercise device, pushing force exerted by a user, torque applied by the motor, motor current, motor voltage, motor speed, amount of rotation of a motor or a wheel, wheel speed, acceleration, angular movement, temperature, time, elapsed time, global position, etc.

In some embodiments, a sensor to determine the amount of travel or a direction of travel of the exercise device can measure operation of one or more motors and/or wheels. In some embodiments, a sensor, such as a motor encoder, can detect the rotation of a motor or a wheel, and can be used, for example, to determine travel distance, travel speed, linearity of travel (such as by comparing the rotation of two wheels or motors), rotation of the device during operation (yaw), acceleration, smoothness of motion (lack of accelerations/decelerations during operation), commencement of an exercise routine or repetition, change of direction at maximum travel during a repetition, and stopping the exercise device such as to end an exercise routine.

In some embodiments, acceleration sensors, such as accelerometers, can be used to determine the same parameters as a sensor that detects the rotation of a motor or a wheel. For example, when an exercise routine begins, the accelerometer or other acceleration sensor can determine the rate of change in speed of the exercise device. This parameter combined with time can allow determination of the distance and direction of travel and speed of travel. The direct measurement of acceleration also allows determination of changes in speed, linearity of travel, acceleration, smoothness of motion, etc. In addition, acceleration sensor, such as an accelerometer, can determine twisting of the exercise device or tilting of the platform or other part of the exercise device. Accordingly, the acceleration sensor can also provide determination of yaw.

In some embodiments, torque can be measured directly by a torque meter (torque sensor) or implied from motor operational parameters, such as one or more of voltage, current, pulse characteristics, frequency and speed.

In some embodiments, one or more sensors can detect when a user places his/her hand(s) or foot/feet, knee(s), elbow(s), arm(s) or other body part on the exercise device to begin an exercise. Suitable sensors can include contact sensors, pressure sensors, proximity sensors, capacitance sensors, etc. In some embodiments, the sensor can detect where the user contacts the exercise device. In some embodiments, the location of contact can be used to identify the type of exercise to be performed.

In some embodiments, the exercise device can be set for a particular exercise routine among a plurality of exercise routines. In some embodiments, a selection of exercise routine can be made with the user interface. In some embodiments, the selection of a particular exercise routine can load motor parameters and a set of data or parameters to be used for comparison of the current exercise session to previous, target, idealized or model exercise session(s).

In some embodiments, a camera or camera system can be used in evaluating the user form or position in performing an exercise. In some embodiments, an evaluation image or data can be collected by a camera or camera system of a user performing an exercise, and then the evaluation image or data is compared to an image or image data of a comparison image or image data to identify conformities and differences between the evaluation image or data and the comparison image or data. (Conformities are areas of the images or data that correspond to one another and differences are areas where there are differences between the images or image data.) In some embodiments, the conformities or differences can relate to the position of a body part during performance of an exercise, such as head position, straightness of back, slope of back, angle of a joint, such as an elbow or shoulder, extent of movement, etc. In some comparisons, an overlaid image can be created by overlaying an evaluation image and a comparison image on one another. In some embodiments, the overlaid image can be simplified images, such as comprising a stick figure. In some embodiments, conformities or differences can be identified in a displayed image of a user, such as with marking or coloring, or other types of marks to identify the particular areas of the image. For example, an arm of the image can be displayed in a different color or be circled or marked with an arrow. In some embodiments, the image showing the conformities or differences can be an actual image of the user or a representation of the user, such as an avatar or a stick figure or another form used to represent the user and the relevant body parts of the user. In some embodiments, the comparison image can be based upon an idealized model of a user or another user or a previous image of the current user.

Skill Levels

Motor output can be varied to assist the user to achieve a constant speed, with greater or more frequent interventions to correct speed indicating a lower skill level and lesser or less frequent interventions indicating a higher skill level. Motor output can also be varied to assist the user in linearity of travel or to limit tilting or to counter twisting or yaw of the exercise device during operation. Again, greater or more frequent interventions to to correct the operation by the user indicating a lower skill level and lesser or less frequent interventions indicating a higher skill level. Occurrence of such interventions can in some embodiments be tracked over time to determine progression in skill level and can be reported to the user through the user interface or through other reporting methods. In addition, these are can in some embodiments select a skill level which changes how frequently or to what extent interventions will be made by the exercise device, such as through the motor output, to assist the user with an exercise parameter or exercise deviation. In some embodiments, a specific exercise parameter or exercise deviation can be selected for assistance through the motor output.

Further Discussion

Further discussion of exercise devices, exercise device features and exercise device operation are provided in the Appendix to this application. This discussion, the exercise devices, exercise device features, exercise device operation and all other aspects of the description, claims, figures and abstract thereof are made a part of this disclosure. The embodiments and elements of the exercise device and its operation presented in the Appendix can be combined with and substituted for the embodiments and elements of the exercise device of the present disclosure, and embodiments and elements of the exercise device in the present disclosure can be combined with and substituted for the embodiments and elements of the exercise device of the Appendix. For example, the energy storage system and spring system of the Appendix can be interchanged or used in combination with the motor(s) and battery(ies) of the present disclosure and the motor(s) and battery(ies) of the present disclosure can be interchanged or used in combination with the energy storage system and spring system of the Appendix. Further the controls, switches, sensors and operation of the present disclosure can be applied to the exercise device of the Appendix and the controls, switches, sensors and operation of the Appendix can be applied to the exercise device of the present disclosure.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. Use of language such as "approximately", "somewhat", "about", "nearly" and other terms of degree that appear within this disclosure are intended to be interpreted as a person of skill in the art would understand the language based upon the context, with a further understanding that if the context provides insufficient guidance, a tolerance of 20% should be applied. Use of the word "or" should be understood to also include the meaning "and", except where the context indicates otherwise. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims.

The invention claimed is:

1. An exercise device comprising:

a platform having a first end and a second end opposite the first end;

first and second wheels, wherein the first wheel is positioned proximate the first end and the second wheel is positioned proximate the second end and the first and second wheels are configured to roll across a surface as the exercise device is displaced along the surface;

a first motor is configured to apply a first torque to the first wheel where the magnitude of the first torque is related to the distance of the exercise device from a zero position and a direction of the first torque urges the exercise device toward the zero position.

2. The exercise device of claim 1, further comprising a second motor configured to apply a second torque to the second wheel where a magnitude of the second torque is related to the distance of the exercise device from the zero position and the direction of the second torque urges movement of the exercise device toward the zero position.

3. The exercise device of claim 1, further comprising a stabilizing wheel system comprising one or more stabilizing wheels, wherein the one or more stabilizing wheels are positioned and configured to roll across the surface and to limit rotation of the platform in relation to the first and second wheel.

4. The exercise device of claim 1 wherein the surface comprises a continuous horizontal surface extending from the first wheel to the second wheel.

5. The exercise device of claim 1, wherein the surface comprises a first track and a second track where the first wheel rolls on the first track and the second track rolls on the second track.

6. The exercise device of claim 3, wherein there are two stabilizing wheels.

7. The exercise device of claim 3, wherein the first motor is configured to apply a second torque to the second wheel, where the magnitude of the second torque is related to the distance of the exercise device from the zero position and a direction of the second torque urges movement of the exercise device toward the zero position.

8. The exercise device of claim 2 wherein the magnitude of the first torque follows a first pattern as the distance from the zero point increases and the magnitude of the second torque follows a second pattern as the distance from the zero point decreases, where the first and the second pattern are independently selected from:

a linear pattern with constant magnitude, a linear pattern with increasing magnitude with increasing distance from the zero position, a linear pattern with decreasing magnitude with increasing distance from the zero position, a variable pattern with increasing magnitude with increasing distance from the zero position, a variable pattern with decreasing magnitude with increasing distance from the zero position, a variable pattern with decreasing magnitude with increasing distance from the zero position, a variable pattern with increasing then decreasing magnitude with increasing distance from zero, a variable pattern with decreasing then increasing magnitude with increasing distance from zero, and combinations thereof.

9. The exercise device of claim 8, wherein the first pattern is a linear curve with constant magnitude.

10. The exercise device of claim 8, wherein the first pattern has increasing magnitude with increasing distance from the zero position.

11. The exercise device of claim 8, wherein the first pattern has decreasing magnitude with increasing distance from the zero position.

12. The exercise device of claim 8, wherein the first pattern is a linear curve with increasing magnitude with increasing distance from the zero position.

13. The exercise device of claim 8, wherein the first pattern has increasing then decreasing magnitude with increasing distance from zero.

14. The exercise device of claim 8, wherein the first pattern has decreasing then increasing magnitude with increasing distance from zero.

15. The exercise device of claim 8, wherein the first pattern is different from the second pattern.

16. A method of operating the exercise device of claim 2 comprising:

the first or second motor applying a first or second torque to the first or second wheel, respectively as the exercise device is pushed across the surface away from the zero position, where the first or second torque opposes the motion of the exercise device; and the first or second motor applying a first or second torque to the first or second wheel, respectively as the exercise device is pushed across the surface toward the zero position, where the first or second anti-return force opposes the motion of the exercise device.

17. The method of claim 16, wherein, the first or second torque is changed to compensate for yaw of the exercise device.

18. The method of claim 16, wherein the first or second torque is changed to compensate for tipping of the platform in relation to the first or second wheel.

19. The method of operating the exercise device of claim 8, wherein the first or second pattern is selected at the start of an exercise session.

20. The method of operating the exercise device of claim 16, wherein the first or second torque is changed when the acceleration of the exercise device away from or toward the zero position exceeds a preset value.

21. An exercise system comprising:

the exercise device of claim 1; and a user interface configured to provide an indication of an exercise parameter achieved or an exercise deviation performed to a user of the exercise device.

22. The exercise system of claim 21, wherein the user interface provides a haptic indication to the user.

23. The exercise system of claim 21, wherein the user interface comprises a visual display in the exercise device.

24. The exercise system of claim 21, wherein the user interface comprises a visual display external to the exercise device.

25. The exercise system of claim 21, wherein the user interface comprises an audio signal.

26. The exercise system of claim 21, wherein the indication of an exercise parameter achieved comprises a display of a representation of the user's position operating the exercise device and a standard position of operation of the exercise device.

27. The exercise system of claim 21, wherein the indication of an exercise parameter achieved comprises an indication of a degree of success in achieving a standard movement form during operation of the exercise device.

28. An exercise device comprising:

a platform having a first end and a second end opposite the first end;

first and second wheels, wherein the first wheel is positioned proximate the first end and the second wheel is positioned proximate the second end and the first and second wheels are configured to roll across a surface as the exercise device is displaced along the surface;

the first wheel applies a force that resists movement of the exercise device when the exercise device is moved from a zero position where a magnitude of the force is related to the distance of the exercise device from the zero position and a direction of the force urges the device toward the zero position.

* * * * *